US007361858B2

(12) United States Patent
Shibata et al.

(10) Patent No.: US 7,361,858 B2
(45) Date of Patent: Apr. 22, 2008

(54) SWING SWITCH

(75) Inventors: Minoru Shibata, Aichi-ken (JP); Hirohito Ikuta, Nagoya (JP)

(73) Assignee: Toyoda Gosei Co., Ltd., Aichi-ken (JP)

( * ) Notice: Subject to any disclaimer, the term of this patent is extended or adjusted under 35 U.S.C. 154(b) by 156 days.

(21) Appl. No.: 11/431,568

(22) Filed: May 11, 2006

(65) Prior Publication Data

US 2006/0266633 A1 Nov. 30, 2006

(30) Foreign Application Priority Data

May 30, 2005 (JP) ..... 2005-157621

(51) Int. Cl.
*H01H 3/00* (2006.01)

(52) U.S. Cl. ..... 200/339; 200/296

(58) Field of Classification Search ..... 200/296, 200/336, 310–314, 341–345, 339; 345/168, 345/169; 341/22

See application file for complete search history.

(56) References Cited

U.S. PATENT DOCUMENTS 6,462,292 B1 * 10/2002 Wang ..... 200/315
6,577,221 B1 * 6/2003 Wang ..... 337/59
6,586,694 B2 * 7/2003 Shotey et al. ..... 200/333
6,605,790 B2 * 8/2003 Yoshida ..... 200/339
6,756,553 B1 * 6/2004 Yamaguchi et al. ..... 200/339
6,781,076 B2 * 8/2004 Takiguchi et al. ..... 200/316

FOREIGN PATENT DOCUMENTS

JP A-8-102232 4/1996

* cited by examiner

*Primary Examiner*—Elvin Enad
*Assistant Examiner*—Lisa Klaus
(74) *Attorney, Agent, or Firm*—Posz Law Group, PLC

(57) ABSTRACT

A swing switch, which is disposed in a decorative panel having a surface and an opening, includes a switch body, and a panel-side guide. The switch body has an input element, a switch-side guide, and a swing center. The input element is disposed in the opening of the decorative panel. At least part of the switch-side guide is disposed on the rear side of the input element. The swing center is disposed substantially flush with the input element or the surface of the decorative panel. The switch body swings about the swing center. At least part of the panel-side guide is disposed on the rear side of the input element of the switch body. The switch-side guide of the switch body slides on the panel-side guide, thereby swinging the switch body. The switch-side guide and the panel-side guide support the switch body in a cantilevered manner.

6 Claims, 6 Drawing Sheets

SWING SWITCH

BACKGROUND OF THE INVENTION

1. Field of the Invention

The present invention relates to a swing switch, which is disposed in the operation unit of various instruments, for inputting instructions.

2. Description of the Related Art

A swing switch is made so that the input element swings about an arbitrary swing shaft. Such a swing switch is disposed in the operation unit of acoustic instruments and air-conditioning instruments, for instance. Japanese Unexamined Patent Publication (KOKAI) No. 8-102,232 discloses a conventional swing switch, which is used for turning the volume up and down or tuning to receiving channels in acoustic instruments.

FIGS. 12 through 14 illustrate a conventional swing switch in longitudinal cross section. Specifically, FIG. 12 shows a conventional swing switch 100, which is put in an input standby state. FIGS. 13 and 14 show the conventional swing switch 100, which is put in inputted states, respectively. The conventional swing switch 100 comprises an input element 101, and a swing arm 102. The input element 101 is disposed within an opening 105, which is opened in a decorative panel 103. The swing arm 102 projects from the rear surface of the input element 101. The swing arm 102 is supported pivotably to a swing shaft 104 at the leading end. The swing shaft 104 is fastened to the inner side of the decorative panel 103.

When an operator presses the input element 101 of the conventional swing switch 100 from the front side, the swing switch 100 swings about the swing shaft 104 like a seesaw as shown in FIGS. 12, 13 and 14. In this instance, a clearance "d1," which is present between the outer periphery of the input element 101 and the inner periphery of the opening 105, depends on the swinging angle of the input element 101 when viewed perpendicularly with respect to the outer surface of the decorative panel 103. For example, when an operator inputs a pressing force to swing the input element 101 in the clockwise direction in the drawing as shown in FIG. 13, the clearance "d1" diminishes. On the other hand, when an operator inputs a pressing force to swing the input element 101 in the counterclockwise direction in the drawing as shown in FIG. 14, the clearance "d1" enlarges.

Moreover, when the clearance "d1" diminishes as shown in FIG. 13, there is a fear that the outer periphery of the input element 101 might interfere with the inner periphery of the opening 105. Accordingly, in the conventional swing switch 100, which is put in an input standby state as shown in FIG. 12, the clearance "d1" is designed to be large comparatively while taking the change of clearance "d1," which occurs when an operator inputs a pressing force, into consideration. In addition, another clearance, which is disposed oppositely with resect to the clearance "d1" in the longitudinal direction of the input element 101, that is, the clearance, which diminishes when the conventional swing switch 100 swings in the counterclockwise direction as shown in FIG. 14, is designed to be large comparatively as well due to the same reason as described above. Consequently, comparatively large spaces are present between the opposite sides of the swinging input element 101 and the inner periphery of the opening 105. Therefore, the conventional swing switch 100 has exhibited a poor appearance.

SUMMARY OF THE INVENTION

The present invention has been developed and completed in view of the aforementioned circumstances. It is therefore an object of the present invention to provide a swing switch, which is provided with such a small clearance between the outer periphery of an input element and the inner periphery of an opening that produces a good appearance.

A swing switch according to the present invention can solve the aforementioned problem, is disposed in a decorative panel having a surface and an opening, and comprises:

a switch body having an input element, which is disposed in the opening of the decorative panel and which has a front side and a rear side, a switch-side guide at least part of which is disposed on the rear side of the input element, and a swing center about which the switch body swings and which is disposed substantially flush with the input element or the surface of the decorative panel; and a panel-side guide at least part of which is disposed on the rear side of the input element of the switch body, and on which the switch-side guide of the switch body slides, thereby swinging the switch body;

the switch-side guide of the switch body and the panel-side guide supporting the switch body in a cantilevered manner.

The present swing switch comprises the switch-side guide and panel-side guide, which support the switch body in a cantilevered manner so that the swing center of the switch body is substantially flush with the input element or the surface of the decorative panel when an operator inputs a pressing force to swing the switch body. Accordingly, in the present swing switch which is put in an input standby state, it is unnecessary to design the clearance between the outer periphery of the input element and the inner periphery of the opening (hereinafter simply referred to as a "clearance" wherever appropriate) to be large comparatively while taking the diminishing clearance when an operator inputs a pressing force to swing the switch body into consideration. Consequently, the present swing switch can make the clearance minimum when it is put in an input standby state.

In a first preferable embodiment of the present swing switch, one of the switch-side guide and the panel-side guide comprises a plurality of partially arc-shaped guide holes which are disposed on imaginary concentric circles whose centers coincides with the swing center of the switch body, respectively, and partially arc-shaped guide holes whose arc centers coincide with the swing center, respectively; and the other one of the switch-side guide and the panel-side guide comprises a plurality of guide projections which are disposed on imaginary concentric circles whose centers coincide with the swing center of the switch body, respectively, and guide projections which are fitted into the guide holes, respectively, and guide projections which are disposed slidably in a peripheral direction of the partially arc-shaped guide holes, respectively.

The first preferable embodiment of the present swing switch comprises the partially arc-shaped guide holes, and the guide projections. The partially arc-shaped guide holes are disposed on imaginary concentric circles whose centers coincide with the swing center of the switch body, respectively. Moreover, the arc centers of the partially arc-shaped guide holes coincide with the swing center, respectively. In addition, the guide projections are fitted into the partially arc-shaped guide holes, respectively, and slide in a peripheral direction of the partially arc-shaped guide holes, respectively, thereby swinging the switch body, which is supported in a cantilevered manner, about the swing center. Thus, in accordance with the first preferable embodiment of the present swing switch, a plurality of the partially arc-shaped guide holes and guide projections can inhibit the switch body from moving or rattling in directions other than the swinging directions when the switch body swings. Accordingly, the first preferable embodiment of the present swing switch can hold the posture of the swinging swing switch stably. Consequently, the first preferable embodiment of the present swing switch can operate smoothly.

In a second preferable embodiment of the present swing switch, one of the switch-side guide and the panel-side guide comprises a partially arc-shaped guide hole whose arc center coincides with the swing center of the switch body;

the other one of the switch-side guide and the panel-side guide comprises a guide projection which is fitted into the partially arc-shaped guide hole, and which is disposed slidably in a peripheral direction of the partially arc-shaped guide hole;

the switch-side guide further comprises a hinge extending from the rear surface of the input element in a letter "U" shape, and having a leading end at which a leading-end supported portion is disposed; and the panel-side guide further comprises a supporter portion capable of supporting the leading-end supported portion of the switch-side guide so as to make the leading-end supported portion movable on an imaginary arc whose arc center coincides with the swing center of the switch body.

The second preferable embodiment of the present swing switch comprises the partially arc-shaped guide hole, the guide projection, the hinge, and the supporter. The arc center of the partially arc-shaped guide hole coincides with the swing center of the switch body. The guide projection is fitted into the partially arc-shaped guide hole, and is disposed slidably in a peripheral direction of the partially arc-shaped guide hole. The hinge has a leading end at which a leading-end supported portion is disposed. The guide projection slides in a peripheral direction of the partially arc-shaped guide hole, and the leading-end supported portion of the hinge moves within the supporter on an imaginary arc whose arc center coincides with the swing center of the switch body, thereby swinging the switch body, which is supported in a cantilevered manner, about the swing center. Thus, in accordance with the second preferable embodiment of the present swing switch, the partially arc-shaped guide hole and guide projection inhibit the switch body from moving in directions other than the swinging directions when the switch body swings. Accordingly, when the switch body swings, the second preferable embodiment of the present swing switch can prevent the switch body from moving or rattling in directions other than the swinging directions with the partially arc-shaped guide hole and guide projection. Consequently, the second preferable embodiment of the present swing switch can hold the posture of the swinging swing switch stably. Therefore, the second preferable embodiment of the present swing switch can operate smoothly.

Hence, in accordance with the present invention, it is possible to provide a swing switch, which is provided with such a small clearance between the outer periphery of the input element and the inner periphery of the opening that produces a good appearance.

BRIEF DESCRIPTION OF THE DRAWINGS

A more complete appreciation of the present invention and many of its advantages will be readily obtained as the same becomes better understood by reference to the following detailed description when considered in connection with the accompanying drawings and detailed specification, all of which forms a part of the disclosure.

DETAILED DESCRIPTION OF THE PREFERRED EMBODIMENTS

Having generally described the present invention, a further understanding can be obtained by reference to the specific preferred embodiments which are provided herein for the purpose of illustration only and not intended to limit the scope of the appended claims.

Hereinafter, the present invention will be described with reference to specific examples which embody the present swing switch as a temperature control switch for air-conditioning apparatuses in vehicles.

EXAMPLES

Example No. 1

Figure 1:
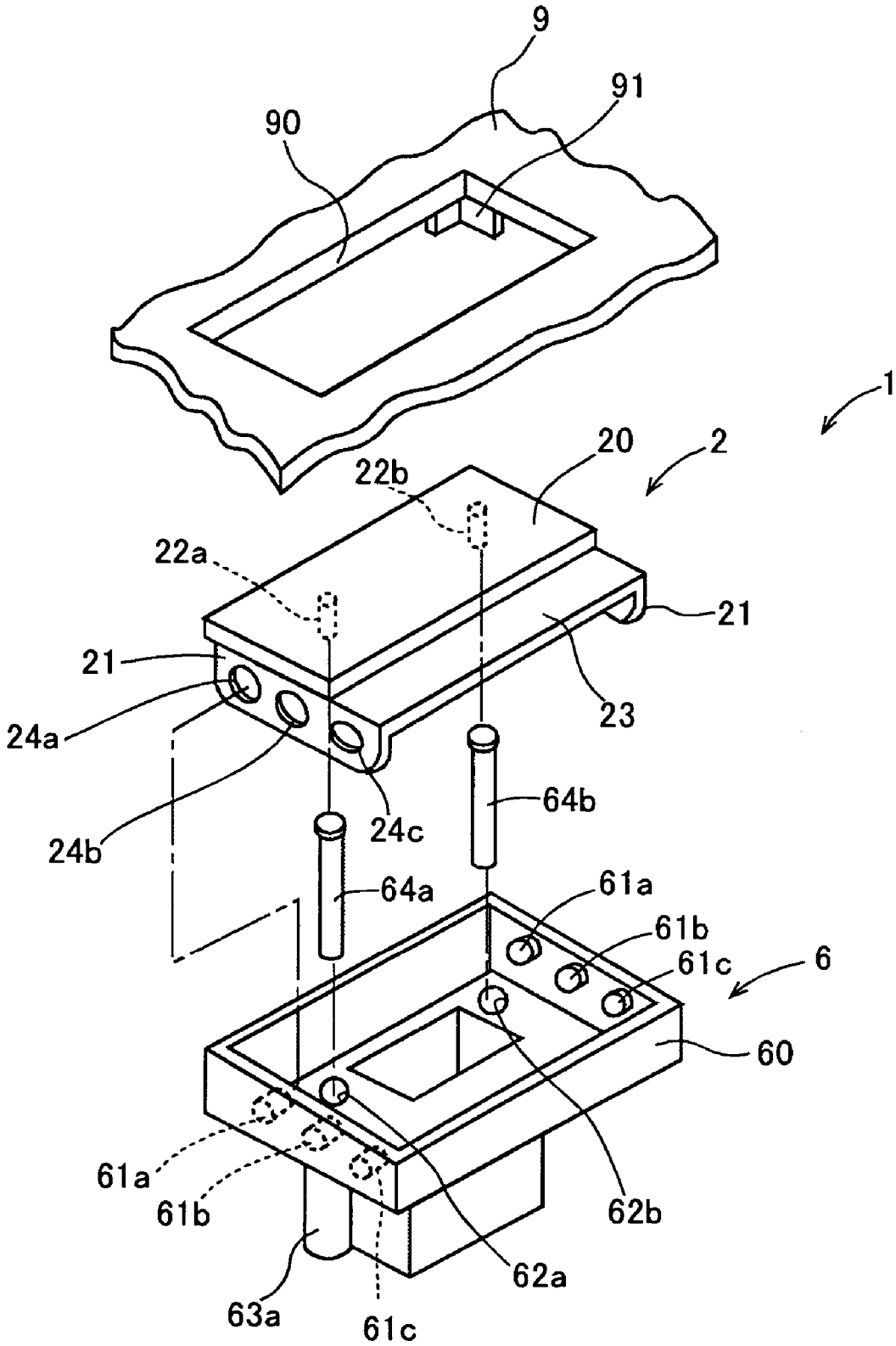
FIG. 1 is an exploded perspective diagram for illustrating a swing switch according to Example No. 1 of the present invention.
Figure 2:
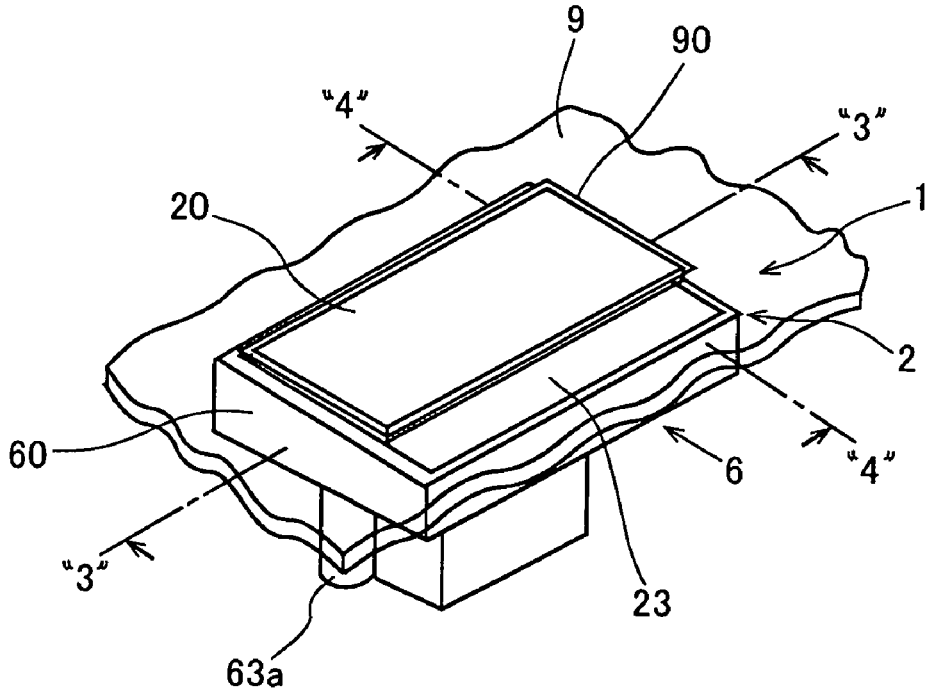
FIG. 2 is an assembled perspective diagram for illustrating the swing switch according to Example No. 1.
Figure 3:
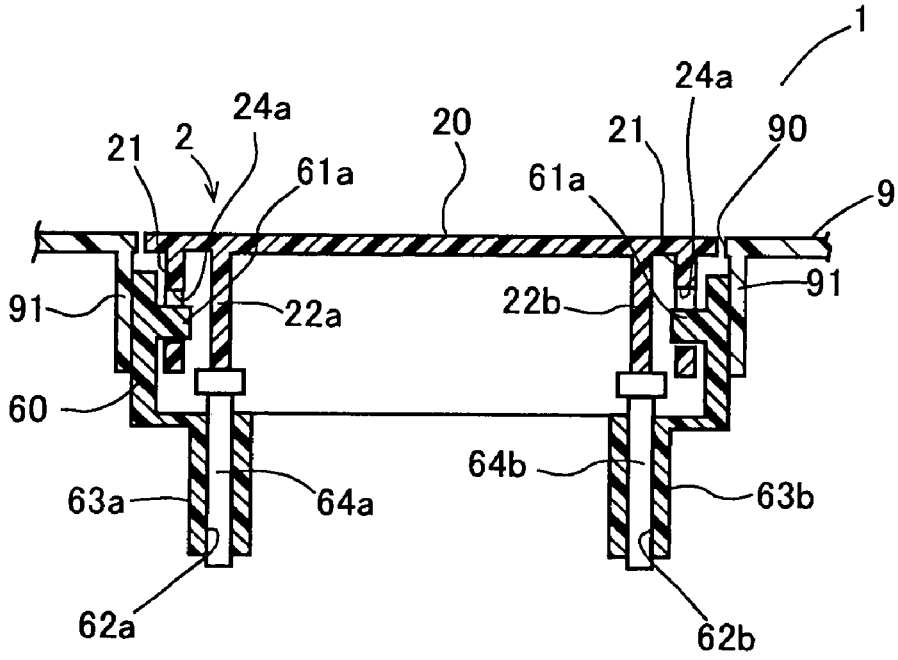
FIG. 3 is a cross-sectional diagram taken along the alternate long-and-short dashed line "3"-"3" of FIG. 2.
Figure 4:
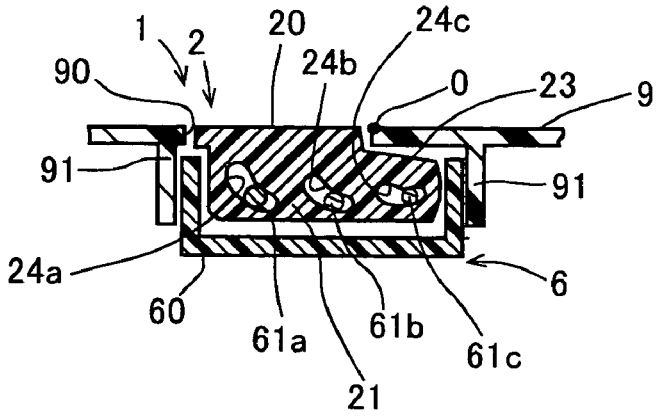
FIG. 4 is a cross-sectional diagram taken along the alternate long-and-short dashed line "4"-"4" of FIG. 2.

First of all, an arrangement of a swing switch according to Example No. 1 of the present invention will be described. FIG. 1 illustrates the swing switch 1 according to Example No. 1 in an exploded perspective diagram. FIG. 2 illustrates the swing switch 1 according to Example No. 1 in an assembled perspective diagram. FIG. 3 is a cross-sectional diagram taken along the alternate long-and-short dashed line "3"-"3" of FIG. 2. In the cross-sectional diagram of FIG. 3, the swing switch 1 according to Example No. 1 is cut at the portion around later-described input pins. FIG. 4 is a cross-sectional diagram taken along the alternate long-and-short dashed line "4"-"4" of FIG. 2. In the cross-sectional diagram of FIG. 4, the swing switch 1 according to Example No. 1 is cut at the portion around later-described arms. Note that, for descriptive convenience, FIG. 2 shows the swing switch 1 according to Example No. 1 in a see-through manner through an instrument panel.

As shown in FIG. 1, the swing switch 1 according to Example No. 1 of the present invention comprises a switch body 2, and a supporting member 6.

The switch body 2 is an integrally molded product composed of resin. The switch body 2 comprises an input element 20, paired arms 21, 21, paired rods 22*a*, 22*b*, and a tongue 23.

The input element 20 is formed as a rectangle-shaped plate. The tongue 23 is formed as a rectangle-shaped plate whose width is made smaller than that of the input element 20. The tongue 23 is disposed at one of the opposite width-wise ends of the input element 20 by way of a step. The input element 20 is disposed within a rectangle-shaped opening 90, which is opened in an instrument panel 9 disposed in a vehicle passenger room. As shown in FIG. 2, the tongue 23 is disposed on the rear side of the instrument panel 9. Note that the claimed decorative panel includes the instrument panel 9.

The paired arms 21, 21 are formed as a rectangle-shaped plate, respectively. The paired arms 21, 21 protrude from the rear surfaces of the input element 20 and tongue 23. Note that the paired arms 21, 21 are disposed on the shorter sides of the input element 20, which face to each other, respectively. The paired arms 21, 21 are provided with a first guide hole 24*a*, a second guide hole 24*b* and a third guide hole 24*c*, respectively. Note that the claimed switch-side guide includes the first guide hole 24*a*, the second guide hole 24*b* and the third guide hole 24*c*.

The first guide hole 24*a*, the second guide hole 24*b* and the third guide hole 24*c* are disposed on imaginary concentric circles, whose centers coincide with the swing center "O" of the switch body 2, respectively. Moreover, the first guide hole 24*a*, the second guide hole 24*b* and the third guide hole 24*c* are formed as partially arc shapes, whose arc centers coincide with the swing center "O" of the switch body 2, respectively. Note that, as shown in FIG. 4, the swing center "O" is present on the surface of the instrument panel 9, and is composed of one of the inner-peripheral longer sides of the opening 90, which faces to the outer periphery of one of the opposite width-wise ends of the input element 20, that is, one of opposite width-wise sides of the input element 20 provided with the tongue 23.

As shown in FIG. 4, the paired first guide holes 24*a*, 24*a*, the paired second guide holes 24*b*, 24*b* and the paired third guide holes 24*c*, 24*c* extend in different directions or at different angles, respectively. Specifically, the paired first guide holes 24*a*, 24*a*, which are disposed most away from the swing center "O" of the switch body 2 among the three paired guide holes 24*a*, 24*a*, 24*b*, 24*b* and 24*c*, 24*c*, extend in a direction, which is most approximate to being perpendicular with respect to the surface of the input element 20. The paired third guide holes 24*c*, 24*c*, which are disposed most adjacent to the swing center "O" among the three paired guide holes 24*a*, 24*a*, 24*b*, 24*b* and 24*c*, 24*c*, extend in a direction, which is most approximate to being parallel with respect to the surface of the input element 20. The paired second guide holes 24*b*, 24*b*, which are disposed between the paired first guide holes 24*a*, 24*a* and the paired third guide 24*c*, 24*c*, extend in an oblique direction with respect to the surface of the input element 20. The paired first guide holes 24*a*, 24*a*, the paired second guide holes 24*b*, 24*b* and the paired third guide holes 24*c*, 24*c* are disposed on a first imaginary circle, a second imaginary circle and a third imaginary circle which are concentric to each other about the swing center "O" of the switch body 2 and whose radii differ to each other, respectively. The paired first guide holes 24*a*, 24*a* are formed as a shape of the partial arc of the first imaginary circle whose radius is the largest. The paired third guide holes 24*c*, 24*c* are formed as a shape of the partial arc of the third imaginary circle whose radius is the smallest. The paired second guide holes 24*b*, 24*b* are formed as a shape of the partial arc of the second imaginary circle which has a medium-sized radius, compared with the radii of the first and third imaginary circles. The paired first guide holes 24*a*, 24*a* and the paired second guide holes 24*b*, 24*b* are disposed on the rear side of the input element 20. Moreover, the paired third guide holes 24*c*, 24*c* are disposed on the rear side of the tongue 23.

Note that FIG. 1 illustrates the first guide hole 24*a*, the second guide hole 24*b* and the third guide hole 24*c*, which are disposed in one of the opposite arms 21, alone. However, the other one of the opposite arms 21 is also provided with the first guide hole 24*a*, the second guide hole 24*b* and the third guide hole 24*c* in the same manner.

The paired rods 22*a*, 22*b* are formed as a round-bar shape. The paired rods 22*a*, 22*b* protrude from the rear surface of the input element 20. Note that the paired rods 22*a*, 22*b* are disposed adjacent to the longitudinal opposite ends of the input element 20, respectively, as well as adjacent to one of the width-wise opposite ends of the input element 20. Specifically, the paired rods 22*a*, 22*b* are disposed adjacent to one of the width-wise opposite ends of the input element 20 which is not provided with the tongue 23 and is disposed away from the swing center "O" of the switch body 23.

The supporting member 6 is an integrally molded product composed of resin. The supporting member 6 comprises a boxed portion 60. The boxed portion 60 has a rectangle-shaped opening, which corresponds to the outer configuration of the input element 20 and tongue 23. Moreover, the boxed portion 60 has four corners, whose outer surfaces engage with the inner surfaces of four letter "L"-shaped bosses 91 protruding from the rear surface of the instrument panel 9. Thus, the supporting member 6 is held to the instrument panel 9. In addition, two of the facing walls of the boxed portion 60, that is, the side walls corresponding to the shorter sides of the rectangle-shaped opening 90, are provided with a first guide projection 61*a*, a second guide projection 61*b* and a third guide projection 61*c*, respectively. Note that the claimed panels-side guide includes the first guide projection 61*a*, the second guide projection 61*b* and the third guide projection 61*c*. The first guide projection 61*a*, the second guide projection 61*b* and the third guide projection 61*c* are formed as a round-bar shape, respectively. The first guide projection 61*a*, the second guide projection 61*b* and the third guide projection 61*c* are disposed on imaginary circles which are concentric to each other about the swing center "O" of the switch body 2. Moreover, the paired first guide projections 61*a*, 61*a*, the paired second guide projections 61*b*, 61*b* and the paired third guide projections 61*c*, 61*c* are fitted into the paired first guide holes 24*a*, 24*a*, the paired second guide holes 24*b*, 24*b* and the paired third guide holes 24*c*, 24*c*, respectively. In addition, the paired first guide projections 61*a*, 61*a*, the paired second guide projections 61*b*, 61*b* and the paired third guide projections 61*c*, 61*c* are disposed slidably along the inner peripheries of the paired first guide holes 24*a*, 24*a*, the paired second guide holes 24*b*, 24*b* and the paired third guide holes 24*c*, 24*c*, respectively. Thus, the paired first guide projections 61*a*, 61*a*, the paired second guide projections 61*b*, 61*b* and the paired third guide projections 61*c*, 61*c* can slide within the paired first guide holes 24*a*, 24*a*, the paired second guide holes 24*b*, 24*b* and the paired third guide holes 24*c*, 24*c* in the arc-shaped peripheral directions of the paired first guide holes 24*a*, 24*a*, the paired second guide holes 24*b*, 24*b* and the paired third guide holes 24*c*, 24*c*, respectively. Note that the paired first guide projections 61*a*, 61*a*, the paired second guide projections 61*b*, 61*b* and the paired third guide projections 61*c*, 61*c* are disposed on the above-described first, second and third imaginary circles, respectively.

As described above, the paired first guide projections 61*a*, 61*a*, the paired second guide projections 61*b*, 61*b* and the paired third guide projections 61*c*, 61*c* slide along the paired first guide holes 24*a*, 24*a*, the paired second guide holes 24*b*, 24*b* and the paired third guide holes 24*c*, 24*c*, respectively. Accordingly, the switch body 2 is made swingable about the swing center "O." Note that, as shown in FIG. 4, the swing center "O" is present on the surface of the instrument panel 9, and is composed of one of the inner-peripheral longer sides of the opening 90, which faces to the outer periphery of one of the opposite width-wise ends of the input element 20, that is, one of opposite width-wise sides of the input element 20 provided with the tongue 23. Moreover, the switch body 2 is supported by the paired first guide projections 61*a*, 61*a*, the paired second guide projections 61*b*, 61*b* and the paired third guide projections 61*c*, 61*c* as well as the paired first guide holes 24*a*, 24*a*, the paired second guide holes 24*b*, 24*b* and the paired third guide holes 24*c*, 24*c* in a three-point supportive manner. Consequently, the switch body 2 is supported to the supporting member 6 and instrument panel 9 in a cantilever manner in which the other width-wise opposite ends of the input element 20, that is, the width-wise opposite end of the input element 20 away from the swing center "O," makes a free end.

As shown in FIG. 3, the bottom wall of the boxed portion 60 of the supporting member 6 is provided with cylindered portions 63*a*, 63*b*. The cylindered portions 63*a*, 63*b* have through holes 62*a*, 62*b*, respectively. The through holes 62*a*, 62*b* open in the outer bottom surface of the boxed portion 60. A round-bar shaped input pin 64*a* is fitted into the through hole 62*a*. Similarly, a round-bar shaped input pin 64*b* is fitted into the through hole 62*b*. The input pins 64*a*, 64*b* are made of resin. Moreover, the rod 22*a* of the switch body 2 is disposed on the top end of the input pin 64*a*. Similarly, the rod 22*b* of the switch body 2 is disposed on the top end of the input pin 64*b*. In addition, the leading-end or free-end surfaces of the rods 22*a*, 22*b* contact with the top-end surfaces of the input pins 64*a*, 64*b*, respectively.

Note that the switch elements of substrate devices (not shown) are disposed on the bottom-end surfaces or free-end surfaces of the input pins 64*a*, 64*b*, respectively. The substrate devices emit temperature-controlling signals.

Figure 5:
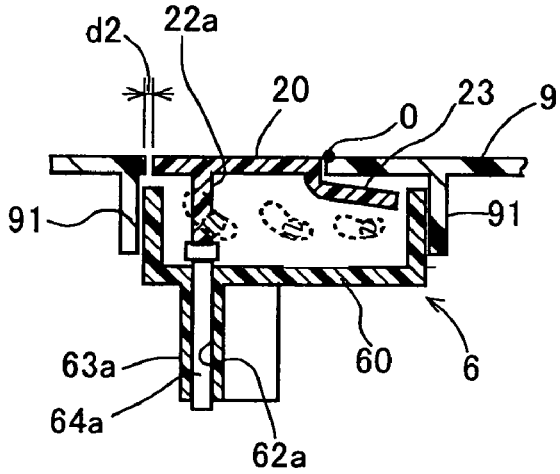
FIG. 5 is a cross-sectional diagram taken in the widthwise direction (or laterally) for illustrating the swing switch according to Example No. 1, which is put in an input standby state.
Figure 6:
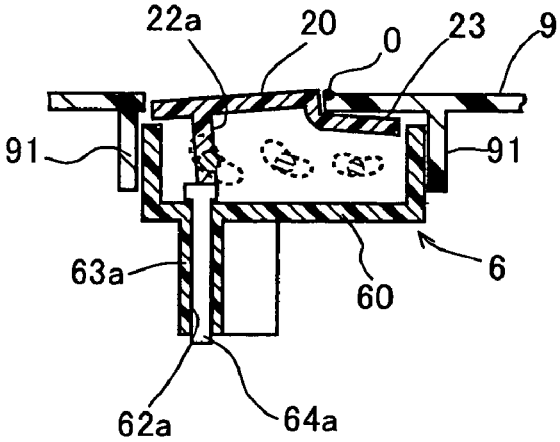
FIG. 6 is a cross-sectional diagram taken in the widthwise direction (or laterally) for illustrating the swing switch according to Example No. 1, which is put in an inputted state.

Hereinafter, how the thus constructed swing switch 1 according to Example No. 1 of the present invention operates will be described in detail with reference to FIGS. 5 and 6. As shown in FIG. 5, the rods 22*a*, 22*b* and the input pins 64*a*, 64*b* align in series in the inner/outer direction. When an operator presses the surface of the input element 20, the paired arms 21, 21 (not shown in FIGS. 5 and 6) swing in the counterclockwise direction in the drawing, as shown in FIG. 6. Accordingly, the paired first guide projections 61*a*, 61*a*, the paired second guide projections 61*b*, 61*b* and the paired third guide projections 61*c*, 61*c*, which protrude from the boxed portion 60 of the supporting member 6, slide along the inner peripheries of the paired first guide holes 24*a*, 24*a*, the paired second guide holes 24*b*, 24*b* and the paired third guide holes 24*c*, 24*c*, which are bored through the paired arms 21, 21 (not shown in FIGS. 5 and 6, but best shown in FIGS. 1, 3 and 4), in the clockwise direction in the drawing relatively to the paired arms 21, 21. Consequently, the switch body 2 swings about the swing center "O" in the counterclockwise direction in the drawing. Therefore, the pressing force, which the operator applies to the input element 20, is transmitted to the switch elements of substrate devices, which are disposed on the bottom-end surfaces or free-end surfaces of the input pins 64*a*, 64*b*, by way of the rods 22*a*, 22*b* and the input pins 64*a*, 64*b*. Eventually, the substrate devices emit temperature-controlling signals. Thus, the operator can convey instructions for controlling temperatures within a vehicle passenger room to an air-conditioning apparatus. When the operator stops pressing the input element 20, the switch elements of substrate devices exert repulsion forces to the input element 20 by way of the input pins 64*a*, 64*b* and rods 22*a*, 22*b* to return the swing switch 1 according to Example No. 1 to the input standby state shown in FIG. 5.

Subsequently, how the swing switch 1 according to Example No. 1 of the present invention produces advantageous effects will be hereinafter described in detail. The swing switch according to Example No. 1 comprises the swing center "O," which is disposed flush with the surface of the instrument panel 9. Accordingly, the space "d2" between the outer periphery of the input element 20 and the inner periphery of the opening 90 is minimized when the swing switch 1 according to Example No. 1 is put in the input standby state shown in FIG. 5. Consequently, the swing switch 1 according to Example No. 1 exhibits a good appearance in the instrument panel 9.

Moreover, the swing switch 1 according to Example No. 1 of the present invention comprises the partially arc-shaped paired first, second and third guide holes 24*a*, 24*a*, 24*b*, 24*b* and 24*c*, 24*c*, and the paired first, second and third guide projections 61*a*, 61*a*, 61*b*, 61*b* and 61*c*, 61*c*. The paired first guide holes 24*a*, 24*a*, the paired second guide holes 24*b*, 24*b* and the paired third guide holes 24*c*, 24*c* are disposed on imaginary concentric circles whose centers coincide with the swing center "O" of the switch body 2, respectively, and their arc centers coincide with the swing center "O," respectively. The paired first guide projections 61*a*, 61*a*, the paired second guide projection 61*b*, 61*b*, and the paired third guide projections 61*c*, 61*c* are fitted into the paired first guide holes 24*a*, 24*a*, the paired second guide holes 24*b*, 24*b* and the paired third guide holes 24*c*, 24*c*, respectively. Moreover, the paired first guide projections 61*b*, 61*b*, the paired second guide projections 61*b*, 61*b*, and the paired third guide projections 61*c*, 61*c* slide within and along the paired first guide holes 24*a*, 24*a*, the paired second guide holes 24*b*, 24*b* and the paired third guide holes 24*c*, 24*c*, respectively, thereby swinging the switch body 2, which is supported in a cantilevered manner, about the swing center "O." As a result, the swing switch 1 according to Example No. 1 can inhibit the switch body 2 from moving or rattling in directions other than the swinging directions with the three paired guide holes and guide projections 24*a* and 61*a*, 24*b* and 61*b*, 24*c* and 61*c* when the switch body 2 swings.

Specifically, since the paired first guide holes 24*a*, 24*a*, which are disposed most away from the swing center "O" of the switch body 2, extend in a direction being most approximately perpendicular with respect to the input element 20, the paired first guide projections 61*a*, 61*a*, which slide along the paired first guide holes 24*a*, 24*a*, can inhibit the swinging switch body 2 from moving or rattling in the parallel direction with respect to the input element 20. Moreover, since the paired third guide holes 24*c*, 24*c*, which are disposed closest to the swing center "O" of the switch body 2, extend in a direction being most approximately parallel with respect to the input element 20, the paired third guide projections 61*c*, 61*c*, which slide along the paired third guide holes 24*c*, 24*c*, can inhibit the swinging switch body 2 from moving or rattling in the perpendicular direction with respect to the input element 20. In addition, since the paired second guide holes 24*b*, 24*b*, which are disposed between the paired first guide holes 24*a*, 24*a* and the paired third guide holes 24*c*, 24*c*, extend in an oblique direction with respect to the input element 20, the paired second guide projections 61*b*, 61*b*, which slide along the paired second guide holes 24*b*, 24*b*, can inhibit the swinging switch body 2 from moving or rattling in an oblique direction, which is perpendicular to the obliquely extending direction of the paired second guide holes 24*b*, 24*b*.

Therefore, the swing switch 1 according to Example No. 1 of the present invention can hold the posture of the swinging switch body 2 stably, and accordingly makes it possible to operate the switch body 2 smoothly.

Moreover, when the swing switch 1 according to Example No. 1 of the present invention is put in the input standby state, the surface of the input element 2 is flush with the surface of the instrument panel 9. Therefore, in addition to the minimized space "d2" between the outer periphery of the input element 20 and the inner periphery of the opening 90, the swing switch 1 according to Example No. 1 enhances the integration between the input element 20 and the switch body 2 decoratively.

Example No. 2

Figure 7:
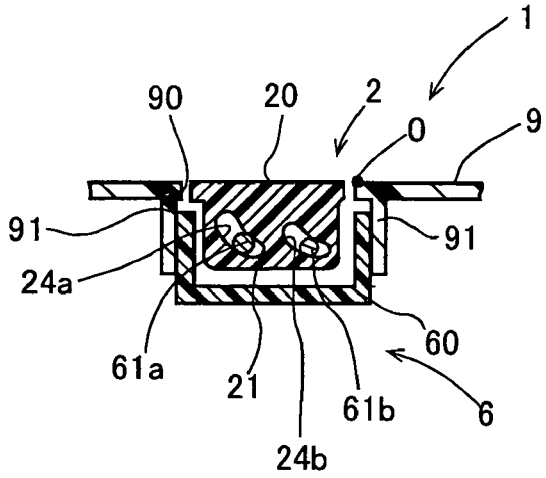
FIG. 7 is a cross-sectional diagram taken in the widthwise direction (or laterally) for illustrating a swing switch according to Example No. 2 of the present invention.

FIG. 7 illustrates a swing switch 1 according to Example No. 2 of the present invention. The drawing is a cross-sectional diagram, which is equivalent to FIG. 4 taken along the alternate long-and-short dashed line "4"-"4" of FIG. 2. That is, FIG. 7 shows the swing switch 1 according to Example No. 2, which is cut at around one of the opposite arms 21, 21 of the switch body 2.

As shown in FIG. 7, the swing switch 1 according to Example No. 2 comprises the paired first guide holes 24*a*, 24*a* and the paired second guide holes 24*b*, 24*b* as well as the paired first guide projections 61*a*, 61*a* and the paired second guide projections 61*b*, 61*b*. The paired first guide holes 24*a*, 24*a* and the paired first guide projections 61*a*, 61*a* as well as the paired second guide holes 24*b*, 24*b* and the paired second guide projections 61*b*, 61*b* support the switch body 2 in a two-point supportive manner, thereby supporting the switch body 2 in a cantilever manner.

Specifically, the swing switch 1 according to Example No. 2 of the present invention comprises the switch body 2, which is free of the tongue 23, one of the component parts of the switch body 2 in the swing switch 1 according to Example No. 1. The paired arms 21, 21 protrude from the rear or inner surface of the input element 20. The paired arms 21, 21 are provided with the first guide hole 24*a* and the second guide hole 24*b*, respectively. Moreover, the facing side walls of the boxed portion 60 of the supporting member 6 are provided with the first guide projection 61*a* and the second guide projection 61*b*, respectively. Note that the paired first guide holes 24*a*, 24*a* and the paired second guide holes 24*b*, 24*b* as well as the paired first guide projections 61*a*, 61*a* and the paired second guide projections 61*b*, 61*b* are constructed in the same manner as those of the swing switch 1 according to Example No. 1.

Except the above-described component parts, the swing switch 1 according to Example No. 2 of the present invention comprises the same component parts as those of the swing switch 1 according to Example No. 1.

Therefore, the swing switch 1 according to Example No. 2 of the present invention operates and produces advantageous effects in the same manner as the swing switch 1 according to Example No. 1 fundamentally.

Example No. 3

Figure 8:
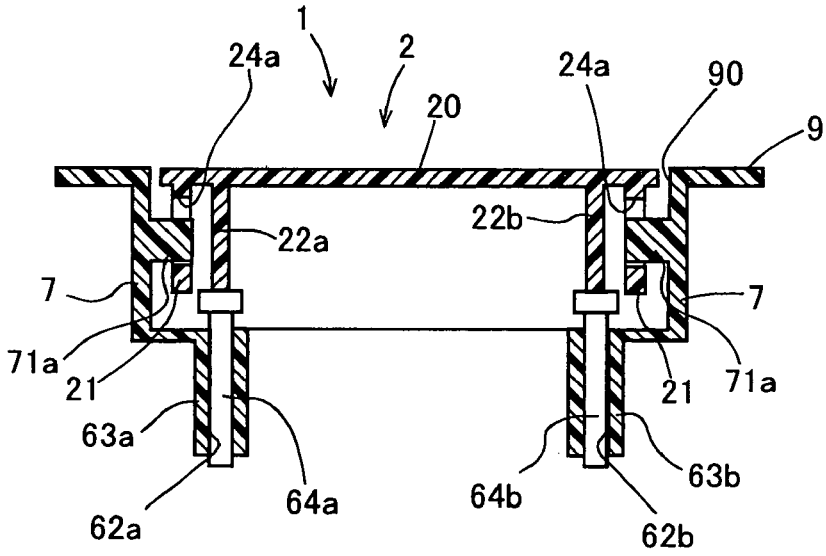
FIG. 8 is a cross-sectional diagram taken in the lengthwise direction (or longitudinally) for illustrating a swing switch according to Example No. 3 of the present invention.
Figure 9:
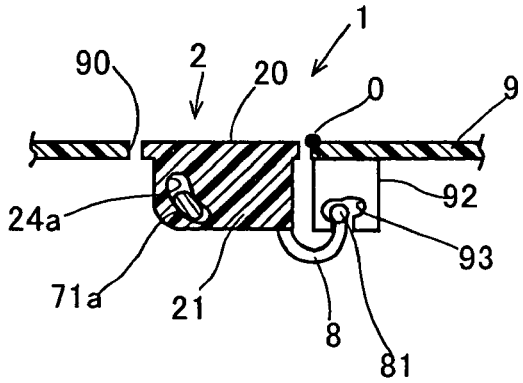
FIG. 9 is a cross-sectional diagram taken in the widthwise direction (or laterally) for illustrating the swing switch according to Example No. 3.

FIGS. 8 through 11 illustrate a swing switch 1 according to Example No. 3 of the present invention. Specifically, FIG. 8 is a cross-sectional diagram, which is equivalent to FIG. 3 taken along the alternate long-and-short dashed line "3"-"3" of FIG. 2. That is, FIG. 8 shows the swing switch 1 according to. Example No. 3, which is cut at around the input pins 64*a*, 64*b* of the supporting member 6. FIG. 9 is a cross-sectional diagram, which is equivalent to FIG. 4 taken along the alternate long-and-short dashed line "4"-"4" of FIG. 2. That is, FIG. 9 shows the swing switch according to Example No. 3, which is cut at around one of the opposite arms 21, 21 of the switch body 2.

As shown in FIGS. 8 through 11, the swing switch 1 according to Example No. 3 of the present invention is free of the supporting member 6 of the swing switch 1 according to Example Nos. 1 and 2. Accordingly, the switch body 2 is provided with paired guide holes, and the instrument panel 9 is provided with paired guide projections.

Specifically, in the swing switch 1 according to Example No. 3 of the present invention, the switch body 2 is free of the tongue 23 of the switch body 2 in the swing switch 1 according to Example Nos. 1 and 2. Moreover, paired arms 21, 21 protrude from the inner or rear surface of the input element 20. The paired arms 21, 21 are provided with a first guide hole 24*a* alone, respectively, but are not at all provided with the second guide hole 24*b* and the third guide hole 24*c*, respectively.

As shown in FIG. 8, paired supporting tabs 7, 7 protrude integrally from the inner or rear surface of the instrument panel 9. The paired supporting tabs 7, 7 are formed as a rectangle-plate shape, respectively. The paired supporting tabs 7, 7 are disposed on the opposite shorter sides of the opening 90 of the instrument panel 9 so as to face to each other. The paired supporting tabs 7, 7 are provided with a first guide projection 71*a* alone, respectively, but are not at all provided with the second guide projection 61*b* and the third guide projection 61*c*, respectively. Moreover, the paired first guide projections 71*a*, 71*a* are formed as a partial arc shape whose arc center coincides with the swing center "O" of the swing body 2. In addition, the paired first guide projections 71*a*, 71*a* are designed to have a shorter arc length than the arc length of the paired first guide holes 24*a*, 24*a*.

Figure 10:
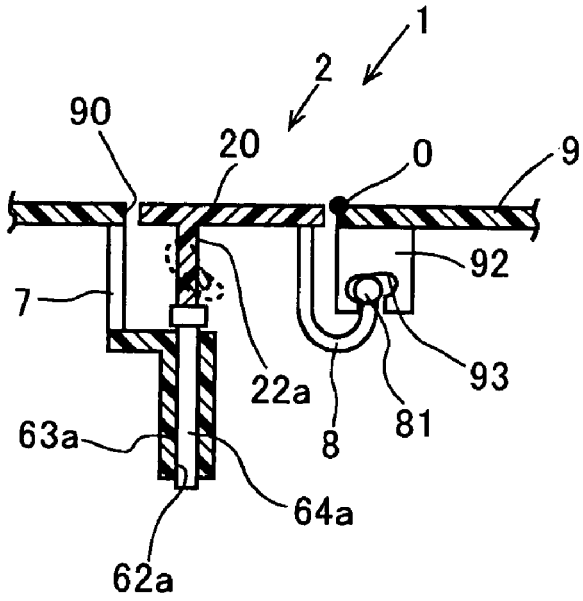
FIG. 10 is a cross-sectional diagram taken in the widthwise direction (or laterally) for illustrating the swing switch according to Example No. 3, which is put in an input standby state.
Figure 11:
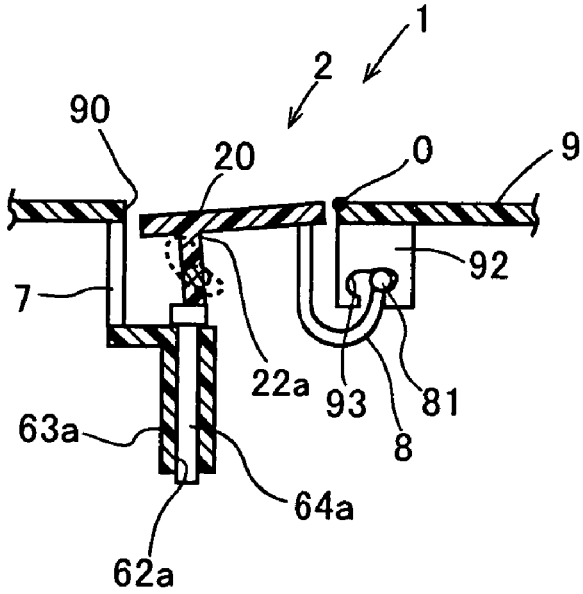
FIG. 11 is a cross-sectional diagram taken in the widthwise direction (or laterally) for illustrating the swing switch according to Example No. 3, which is put in an inputted state.
Figure 12:
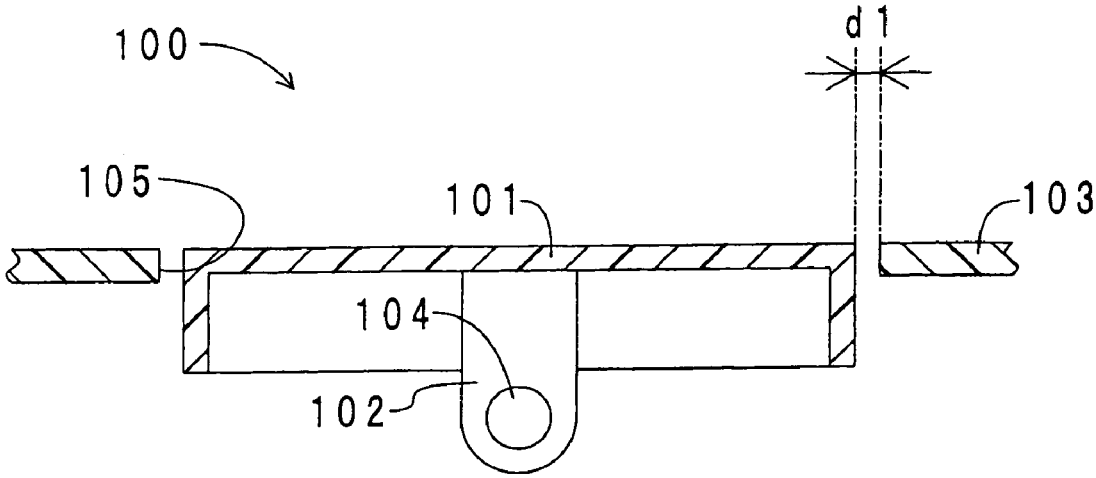
Fig.12 (Prior Art)
FIG. 12 is a cross-sectional diagram taken longitudinally for illustrating a conventional swing switch, which is put in an input standby state.
Figure 13:
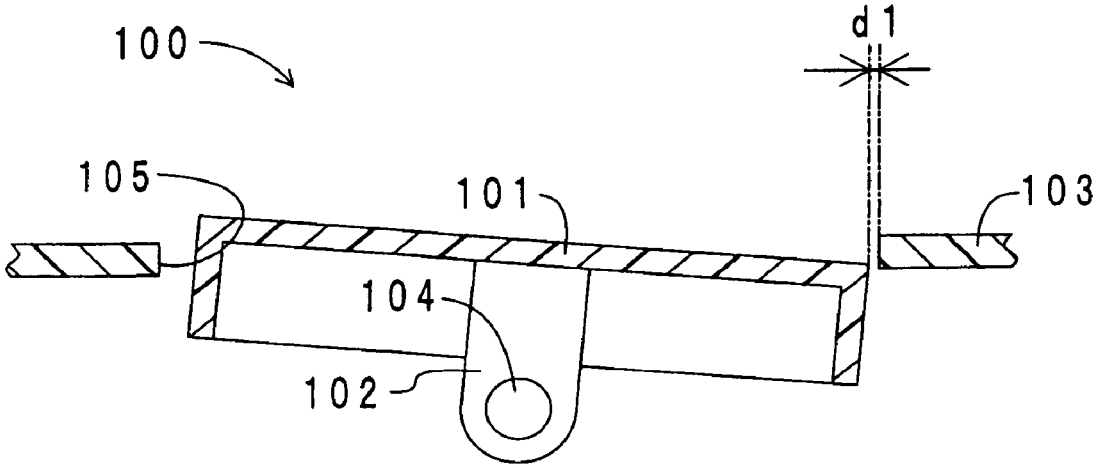
Fig.13 (Prior Art)
FIG. 13 is a cross-sectional diagram taken longitudinally for illustrating the conventional swing switch, which is put in an inputted state.
Figure 14:
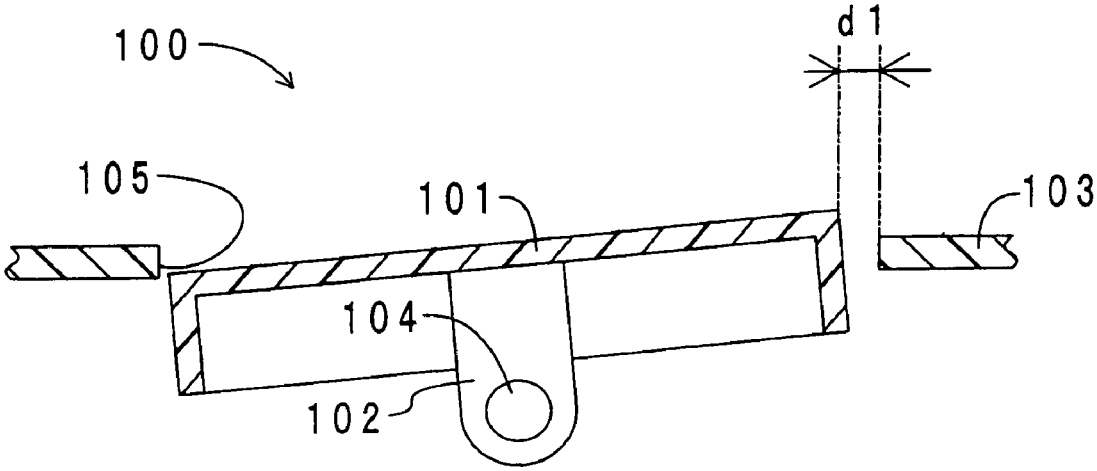
Fig.14 (Prior Art)
FIG. 14 is a cross-sectional diagram taken longitudinally for illustrating the conventional swing switch, which is put in an inputted state.

As shown in FIGS. 9 through 11, the paired first guide holes 24*a*, 24*a* extend in the a direction being nearly perpendicular with respect to the surface of the input element 20 in the same manner as the paired first guide holes 24*a*, 24*a* in the swing switch 1 according to Example Nos. 1 and 2.

Moreover, as shown in FIGS. 9 through 11, the switch body 2 is further provided with a hinge 8. The hinge 8 extends from the rear or inner surface of the input element 20 of the switch body 2 in a letter "U" shape. The hinge 8 is disposed integrally adjacent to one of the width-wise opposite ends of the input element 20, that is, one of the width-wise opposite ends of the input element 20 which is disposed close to the swing center "O" of the switch body 2. In addition, the hinge 8 is provided with a leading-end supported portion 81 at the leading end. The leading-end supported portion 81 is formed as a round-bar shape, which extends in the longitudinal direction of the input element 20. Note that the claimed switch-side guide includes the hinge 8.

As shown in FIGS. 9 through 11, the instrument panel 9 is provided with a supporter portion 92, which protrudes from the rear or inner surface of the instrument panel 9. The supporter portion 92 can support the leading-end supported portion 81 of the hinge 8 so that the leading-end supported portion 81 moves on an imaginary arc whose arc center coincides with the swing center "O" of the switch body 2. Moreover, the supporter portion 92 has a partially-arc-shaped guide dent 93 whose arc center coincides with the swing center "O." Note that the claimed panel-side guide includes the guide dent 93 of the supporter portion 92. The guide dent 93 extends in a direction being nearly parallel with respect to the surface of the input element 20.

Note that the cylindered portions 63*a*, 63*b*, into which the input pin 64*a*, 64*b* are fitted, are disposed integrally at the leading ends of the paired supporting tabs 7, 7, respectively, as shown in FIG. 8.

Except the above-described component parts, the swing switch 1 according to Example No. 3 of the present invention comprises the same component parts as those of the swing switch 1 according to Example No. 1.

Therefore, the swing switch 1 according to Example No. 3 of the present invention operates and produces advantageous effects in the same manner as the swing switch 1 according to Example No. 1 fundamentally.

Specifically, when an operator presses the surface of the input element 20 of the swing switch 1 according Example No. 3 of the present invention, which is put in the input standby state shown in FIG. 10 similarly to the swing switch 1 according Example No. 1, the paired arms 21, 21 (not shown in FIGS. 10 and 11) swing in the counterclockwise direction in the drawing. Accordingly, as shown in FIG. 11, the paired first guide projections 71*a*, 71*a*, which protrude from the paired supporting tab 7, 7, slide along the paired first guide holes 24*a*, 24*a*, which are bored through the paired arms 21, 21 (not shown in FIGS. 10 and 11), in the clockwise direction in the drawing relatively to the paired arms 21, 21. Moreover, the guide dent 93 of the supporter portion 92 guides the leading-end supported portion 81 of the hinge 8 to swing it in the counterclockwise direction in the drawing. Consequently, the switch body 2 swings about the swing center "O" in the counterclockwise direction in the drawing. Note that, when the swing body 2 thus swings, the swing body 2 swings about the swing center "O," which is disposed flush with the surface of the instrument panel 9. Accordingly, the space "d2" between the outer periphery of the input element 20 and the inner periphery of the opening 90 is minimized when the swing switch 1 according to Example No. 3 is put in the input standby state shown in FIG. 10. Consequently, the swing switch 1 according to Example No. 3 exhibits a good appearance in the instrument panel 9.

Moreover, in the swing switch 1 according to Example No. 3 of the present invention, the paired first guide projections 71*a*, 71*a* slide within the paired partially arc-shaped first guide holes 24*a*, 24*a*, whose arc centers coincide with the swing center "O" of the switch body 2, and along the paired partially arc-shaped first guide holes 24*a*, 24*a*. At the same time, the leading-end supported portion 81 of the hinge 8 moves on the arc-shaped periphery of the partially arc-shaped guide dent 93 of the supporter portion 92, whose arc center coincides with the swing center "O," with respect to the supporter portion 92 while being guided by the guide dent 93. Eventually, the switch body 2, which is held in a cantilevered manner, swings about the swing center "O." Thus, the paired first guide projections 71*a*, 71*a* and the paired first guide holes 24*a*, 24*a* as well as the guide dent 93 of the supporter portion 92 and the leading-end supported portion 81 of the hinge 8 inhibit the swinging switch body 2 from moving in directions other than the swinging directions. Hence, the swing switch 1 according to Example No. 3 can prevent the switch body 2 from moving or rattling in directions other than the swinging directions.

Specifically, since the paired first guide holes 24*a*, 24*a*, which are disposed away from the swing center "O" of the switch body 2, extend in a direction being approximately perpendicular with respect to the surface of the input element 20, the paired first guide projections 71*a*, 71*a*, which slide along the paired first guide holes 24*a*, 24*a*, can inhibit the swinging switch body 2 from moving or rattling in the parallel direction with respect to the surface of the input element 20. Moreover, since the guide dent 93 of the supporter portion 92, which is disposed close to the swing center "O" of the switch body 2, extends in a direction being approximately parallel with respect to the surface of the input element 20, the leading-end supported portion 81 of the hinge 8, which slides along the guide dent 93, can inhibit the swinging switch body 2 from moving or rattling in the perpendicular direction with respect to the surface of the input element 20.

Therefore, the swing switch 1 according to Example No. 3 of the present invention can hold the posture of the swinging switch body 2 stably, and accordingly makes it possible to operate the switch body 2 smoothly.

Moreover, the swing switch 1 according to Example No. 3 of the present invention is free of the supporting member 6, which is disposed in the swing switch 1 according to Example Nos. 1 and 2. Accordingly, the swing switch 1 according to Example No. 3 comprises a reduced number of component parts. In addition, it is unnecessary to design the space "d2" between the outer periphery of the input element 20 and the inner periphery of the opening 90 while taking the errors resulting from the supporting member 6, such as the errors in molding the supporting member 6 itself, the errors in assembling the supporting member 6 with the switch body 2 and the displacements between the supporting member 6 and the opening 90 of the instrument panel 9, into consideration. Therefore, it is possible to furthermore reduce the space "d2" between the outer periphery of the input element 20 and the inner periphery of the opening 90.

Modified Version

A few of the preferred embodiments of the present swing switch have been described so far. However, the preferred embodiments of the present swing switch are not at all limited to the above-described specific examples. It is possible as well to embody the present swing switch in such various modified modes or improved modes that a person having ordinary skill in the art can carry out. For example, the present swing switch can be applied not only to air-conditioning instruments but also to all instruments, such as acoustic instruments, navigation instruments and home electric appliances, almost unlimitedly.

Note that the present swing switch is effective especially when it is combined with decorative panels, such as the instrument panel 9, whose external surfaces have desirably been required to be made flush with their own component parts, because it can provide the minimized space between the switch body and the decorative panels' openings.

Having now fully described the present invention, it will be apparent to one of ordinary skill in the art that many changes and modifications can be made thereto without departing from the spirit or scope of the present invention as set forth herein including the appended claims.

What is claimed is:

1. A swing switch, disposed in a decorative panel having a surface and an opening, the swing switch comprising:

a switch body having an input element, which is disposed in the opening of the decorative panel and which has a front side and a rear side, a switch-side guide at least part of which is disposed on the rear side of the input element, and a swing center about which the switch body swings and which is disposed substantially flush with the input element or the surface of the decorative panel; and a panel-side guide at least part of which is disposed on the rear side of the input element of the switch body, and on which the switch-side guide of the switch body slides, thereby swinging the switch body;

the switch-side guide of the switch body and the panel-side guide supporting the switch body in a cantilevered manner.

2. The swing switch set forth in claim 1, wherein:

one of the switch-side guide and the panel-side guide comprises a plurality of partially arc-shaped guide holes which are disposed on imaginary concentric circles whose centers coincides with the swing center of the switch body, respectively, and partially arc-shaped guide holes whose arc centers coincide with the swing center, respectively; and the other one of the switch-side guide and the panel-side guide comprises a plurality of guide projections which are disposed on imaginary concentric circles whose centers coincide with the swing center of the switch body, respectively, and guide projections which are fitted into the guide holes, respectively, and guide projections which are disposed slidably in a peripheral direction of the partially arc-shaped guide holes, respectively.

3. The swing switch set forth in claim 2, wherein the arc-shaped guide holes are disposed so as to extend at different angles, which vary from small to large in a direction away from the swing center of the switch body, to each other with respect to the input element of the switch body.

4. The swing switch set forth in claim 1, wherein:

one of the switch-side guide and the panel-side guide comprises a partially arc-shaped guide hole whose arc center coincides with the swing center of the switch body;

the other one of the switch-side guide and the panel-side guide comprises a guide projection which is fitted into the partially arc-shaped guide hole, and which is disposed slidably in a peripheral direction of the partially arc-shaped guide hole;

the switch-side guide further comprises a hinge extending from the rear surface of the input element in a letter "U" shape, and having a leading end at which a leading-end supported portion is disposed; and the panel-side guide further comprises a supporter portion capable of supporting the leading-end supported portion of the switch-side guide so as to make the leading-end supported portion movable on an imaginary arc whose arc center coincides with the swing center of the switch body.

5. The swing switch set forth in claim 4, wherein the decorative panel further has the panel-side guide, which is provided with the supporter portion.

6. The swing switch set forth in claim 1, wherein:

said switch-side guide of the switch body comprises paired switch-side guides disposed to face to each other; and said panel-side guide comprises paired panel-side guides disposed to face to each other.

* * * * *